US010143351B2

(12) United States Patent
Xu

(10) Patent No.: US 10,143,351 B2
(45) Date of Patent: Dec. 4, 2018

(54) CLEANING BALL OR CLEANING CLOTH, AND MANUFACTURING METHOD AND MANUFACTURING DEVICE THEREOF

(71) Applicant: Yunyou Xu, Taizhou (CN)

(72) Inventor: Yunyou Xu, Taizhou (CN)

( * ) Notice: Subject to any disclaimer, the term of this patent is extended or adjusted under 35 U.S.C. 154(b) by 420 days.

(21) Appl. No.: 15/008,450

(22) Filed: Jan. 28, 2016

(65) Prior Publication Data

US 2016/0183757 A1 Jun. 30, 2016

Related U.S. Application Data

(63) Continuation of application No. PCT/CN2014/088877, filed on Oct. 18, 2014.

(30) Foreign Application Priority Data

Oct. 18, 2013 (CN) ..... 2013 1 0489739

(51) Int. Cl.

| | |
|---|---|
| ***A46D 3/00*** | (2006.01) |
| ***A47L 13/16*** | (2006.01) |
| ***A47L 17/08*** | (2006.01) |
| ***D03D 1/00*** | (2006.01) |
| ***B08B 1/00*** | (2006.01) |

(52) U.S. Cl.
CPC ..... *A47L 13/16* (2013.01); *A46D 3/00* (2013.01); *A47L 17/08* (2013.01); *B08B 1/00* (2013.01); *D03D 1/0023* (2013.01)

(58) Field of Classification Search
CPC ..... A46D 3/00; A47L 13/16; A47L 17/08; D03D 1/0023; D04C 3/40
See application file for complete search history.

(56) References Cited

U.S. PATENT DOCUMENTS 6,129,092 A * 10/2000 Mondl ..... B08B 1/00 134/42
2010/0162508 A1* 7/2010 Olhe ..... A47L 13/16 15/229.11

* cited by examiner

*Primary Examiner* — Randall Chin
(74) *Attorney, Agent, or Firm* — Wayne & Ken, LLC; Tony Hom

(57) ABSTRACT

The present invention discloses a cleaning ball or cleaning cloth, comprising a fluffy main body, wherein the main body is made from fiber yarn and the fiber yarn is made from polyester fibers with a low melting point of which the melting point is below 180° C. The present application can ensure that the cleaning ball or cleaning cloth does not deform or reduce the dirt removing power no matter how long it is used and has the characteristic that plastic fibers are not easy to scratch the object surface. The present invention also discloses a manufacturing method and manufacturing device for the cleaning ball or cleaning cloth.

2 Claims, 8 Drawing Sheets

CLEANING BALL OR CLEANING CLOTH, AND MANUFACTURING METHOD AND MANUFACTURING DEVICE THEREOF

CROSS-REFERENCE TO RELATED APPLICATIONS

This application is a continuation of international Patent Application No. PCT/CN2014/088877 with an international filing date of Oct. 18, 2014 designating the United States, now pending and further claims priority benefits to Chinese Patent Application No. 201310489739.9 filed Oct. 18, 2013. The content of the aforementioned applications, including any intervening amendments thereto, is incorporated herein by reference.

TECHNICAL FIELD

The present invention relates to a cleaning ball or cleaning cloth and manufacturing method and manufacturing device thereof.

BACKGROUND OF THE PRESENT INVENTION

The cleaning ball is a netted ball body. The traditional cleaning ball is formed by self-twining plastic or steel wires and removes dirt on the object surface in a frictional manner by that a surface body with irregular fibers arranged thereon comes into contact with an object surface to be cleaned.

The cleaning cloth is a cloth-shaped cleaning product formed by weaving flexible fibers, and is usually made by a towel machine.

Because the cleaning ball or cleaning cloth is often immersed in water and cleaning agent, after long-term use, the cleaning ball made of plastic material is easy to get loose, fibers are easy to get soft and the dirt removing power is weakened. However, the cleaning ball made of steel wire material has constant dirt removing power, but the cleaning ball made of steel wire material is easy to get rusty or get hard and crack after being used for a period of time, causing declined dirt removing power and unstable service life, and needs to be regularly replaced. Moreover, ball wires of the broken cleaning ball are sometimes mixed into food, having certain potential safety hazard.

Compared with the cleaning ball of steel wire, the plastic cleaning ball has softer plastic fibers and is not easy to scratch the object surface, such as nonstick pan and range hood, etc. during cleaning. However, the existing popular cleaning ball on the market is made from natural fibers, such as bamboo fibers, towel gourd shells, etc., but these products cannot solve the problems of short service life and reduction of dirt removing power after use. The fibers of the cleaning cloth get soft and the intensity get very low. The cleaning cloth will be damaged with slight force. With the increase of the use frequency, the mass becomes lighter and lighter and the cleaning effect becomes increasingly worse. It is easy to attach oil stains to the fiber surface, so it is difficult to clean.

Therefore, how to ensure the dirt removing power and enable the cleaning ball or cleaning cloth not to get soft? One technical challenge in the technical field of the cleaning ball or cleaning cloth at present is to enable the fibers not to get soft.

Moreover, these cleaning balls or cleaning cloth has narrower application range and is not applicable in some particular conditions. For example, in a marriage, the colored ribbons ejected fall on wooden or marble floor; the adhesion degree between the trodden colored ribbons and the floor is very high; these cleaning balls or cleaning cloth cannot achieve the requirement of scratching the colored ribbons pasted on the floor out of the floor, leaving no trace on the surface and realizing quickness and convenience.

Moreover, the existing device for manufacturing the cleaning ball has simple structure, generally ball rolling machine. The principle is that the plastic or steel wire is twined into a ball shape, while the device for manufacturing the cleaning cloth almost uses a knitting machine and a spinning and weaving machine, similar to the manufacture of a towel. In this respect, the device is also a root cause for hindering the innovation, change and development of the cleaning ball or cleaning cloth.

SUMMARY OF THE PRESENT INVENTION

The present invention aims to solve the technical problems of poor use effect and short service life caused by weakened dirt removing power, soft entirety and soft fibers after the existing cleaning ball or cleaning cloth is used for a long time, provides a cleaning ball or cleaning cloth and manufacturing method for the cleaning ball or cleaning cloth, and also provides a manufacturing device.

The technical solution of the problems to be solved in the present invention is as follows:

The cleaning ball or cleaning cloth comprises a fluffy main body, wherein the main body is made from fiber yarn, characterized in that: the fiber yarn is made from polyester fibers with a low melting point of which the melting point is below 180° C.

The fiber yarn after being heated and shaped presents a regular change or irregular change wavy fiber yarn body or a regular change or irregular change spring-shaped fiber yarn body.

The ball body or cloth body formed by twining or weaving the fiber yarn body clads the periphery of the sponge.

A manufacturing method for a cleaning ball is characterized by comprising the following steps:

One, selecting raw material center yarn: selecting fiber yarn made from polyester fibers with a low melting point of which the melting point is below 180° C. as the raw material center yarn;

Two, cladding the yarn: cladding the outer surface of the raw material center yarn with stockline formed by terylene or chinlon;

Three, heating: heating the stockline to a melting point value of the polyester fibers with a low melting point;

Four, shaping: twining and shaping the stockline through a heating stick or crushing and shaping by traversing the gaps among a plurality of gears;

Five, balling via a network: balling the shaped stockline on a coiling umbrella via a yarn feeding mouth network; and Six, breaking the yarn to make a finished product: after rated time, cutting the stockline between a yarn feeding mouth and the coiling umbrella to enable the cleaning ball on the umbrella to drop.

Step three to step four can be replaced by the following steps:

Three, knitting: knitting the stockline into wool via a knitting machine;

Four, heating and shaping: heating the space where the wool is located to enable the temperature to achieve the melting point value of the polyester fibers with a low melting point and shaping after the temperature drops; and Five, disassembling: disassembling the wool.

A manufacturing device for a cleaning ball is formed by arraying a plurality of single units, wherein the single units comprise a cladding mechanism and a coiling mechanism; the cladding mechanism comprises a yarn spool, a yarn twisting stator on one side of the yarn spool, and a power belt which provides the yarn twisting stator with rotating power and is connected with a motor; the coiling mechanism comprises a yarn feeding mouth and a coiling umbrella corresponding to the yarn feeding mouth; a heating mechanism and a shaping mechanism are arranged in sequence between the cladding mechanism and the coiling mechanism; the heating mechanism is a spring-shaped pipe body which is hollow inside or is a resistor on the entirety; the shaping mechanism is close to a nozzle of the spring-shaped pipe body, and is a gearset comprising at least two engaged gear shafts in contactor a solid or hollow stick body; and a stick shaft of the stick body and a pipe shaft of the spring-shaped pipe body are concentric or become an angle.

A hollow cavity wall in the spring-shaped pipe body is connected with a steam generator to form a loop.

A conveyer belt is also arranged below the coiling mechanism of the plurality of single units.

A manufacturing method for cleaning cloth is characterized by comprising the following steps:

One, selecting raw material center yarn: selecting fiber yarn made from polyester fibers with a low melting point of which the melting point is below 180° C. as the raw material center yarn;

Two, cladding the yarn: cladding the outer surface of the raw material center yarn with stockline formed by terylene or chinlon;

Three, weaving: weaving the stockline into a barrel shape through the knitting mechanism;

Four, shaping: shaping after heating the knitted fabric to the melting point value of the polyester fibers with a low melting point;

Five, missed stitches: forcing the knitted fabric to penetrate through a flared or shuttle-shaped mould so as to be expanded and stretched so that missed stitches are formed between the fabric; and Six, breaking the yarn to make a finished product: cutting the fiber fabric to finish manufacturing the cleaning cloth.

A manufacturing device for cleaning cloth is formed by arraying a plurality of single units, wherein the single units comprise a cladding mechanism and a spinning and weaving mechanism; the cladding mechanism comprises a yarn spool, a friction roller in friction with the yarn spool, a filament moving rod under the friction roller, a filament moving mouth mounted on the filament moving rod, a yarn twisting stator under the filament moving rod, and a power belt which provides the yarn twisting stator with rotating power and is connected with a motor; a weaving mechanism comprises a weaving machine head arranged under the yarn twisting stator; the manufacturing device is characterized in that: a heating mechanism is arranged under the weaving machine head; the heating mechanism is a barrel body with a cavity; and a flared or shuttle-shaped expansion mould is placed under the heating mechanism.

The outer cavity wall of the barrel body is hollow and a steam generator is connected with the hollow outer cavity to form a loop.

The outer cavity ring of the barrel body is provided with an electric heating wire.

The present invention has the following beneficial effects:

Compared with the prior art, the cleaning ball or cleaning cloth of the present invention is made from polyester fibers with a low melting point of which the melting point is below 180° C., can ensure that the cleaning ball does not deform or reduce the dirt removing power no matter how long it is used, and also has the characteristic that plastic fibers are not easy to scratch the object surface.

Compared with the prior art, the manufacturing method provided by the present invention can introduce the polyester fibers with a low melting point widely applied in the field of nonwoven cloth into the technical field of cleaning ball or cleaning cloth, breaks the technical barrier and has creativity.

Compared with the prior art, the manufacturing device provided by the present invention can manufacture the polyester fibers with a low melting point widely applied in the field of nonwoven cloth into the cleaning ball or cleaning cloth, and has creativity.

DETAILED DESCRIPTION OF THE PRESENT INVENTION

The cleaning ball or cleaning cloth comprises a fluffy main body, wherein the main body is made from fiber yarn and the fiber yarn is made from polyester fibers with a low melting point of which the melting point is below 100° C.

The melting point of the polyester fibers with a low melting point includes 180° C., 170° C., 160° C., 150° C., 140° C., 130° C., 120° C., 110° C., 100° C., 90° C. and 80° C. and the temperature among these values. The preferred melting point of the present invention is 100° C.

The fiber yarn after being heated and shaped presents a regular change or irregular change wavy fiber yarn body or a regular change or irregular change spring-shaped fiber yarn body.

The ball body or cloth body formed by twining or weaving the fiber yarn body clads the periphery of the sponge.

A manufacturing method for a cleaning ball comprises the following steps:

One, selecting raw material center yarn: selecting fiber yarn made from polyester fibers with a low melting point of which the melting point is below 180° C. as the raw material center yarn, and the preferred melting point 100° C.;

Two, cladding the yarn: cladding the outer surface of the raw material enter yarn with chemical fiber material of terylene or chinlon to form stockline;

Three, heating: heating the stockline to a melting point value of the polyester fibers with a low melting point;

Four, shaping: twining and shaping the stockline through a heating stick or crushing and shaping by traversing the gaps among a plurality of gears;

Five, balling via a network: balling the shaped stockline on a coiling umbrella via a yarn feeding mouth network; and Six, breaking the yarn to make a finished product: after rated time, cutting the stockline between a yarn feeding mouth and the coiling umbrella to enable the cleaning ball on the umbrella to drop.

Figure 1:
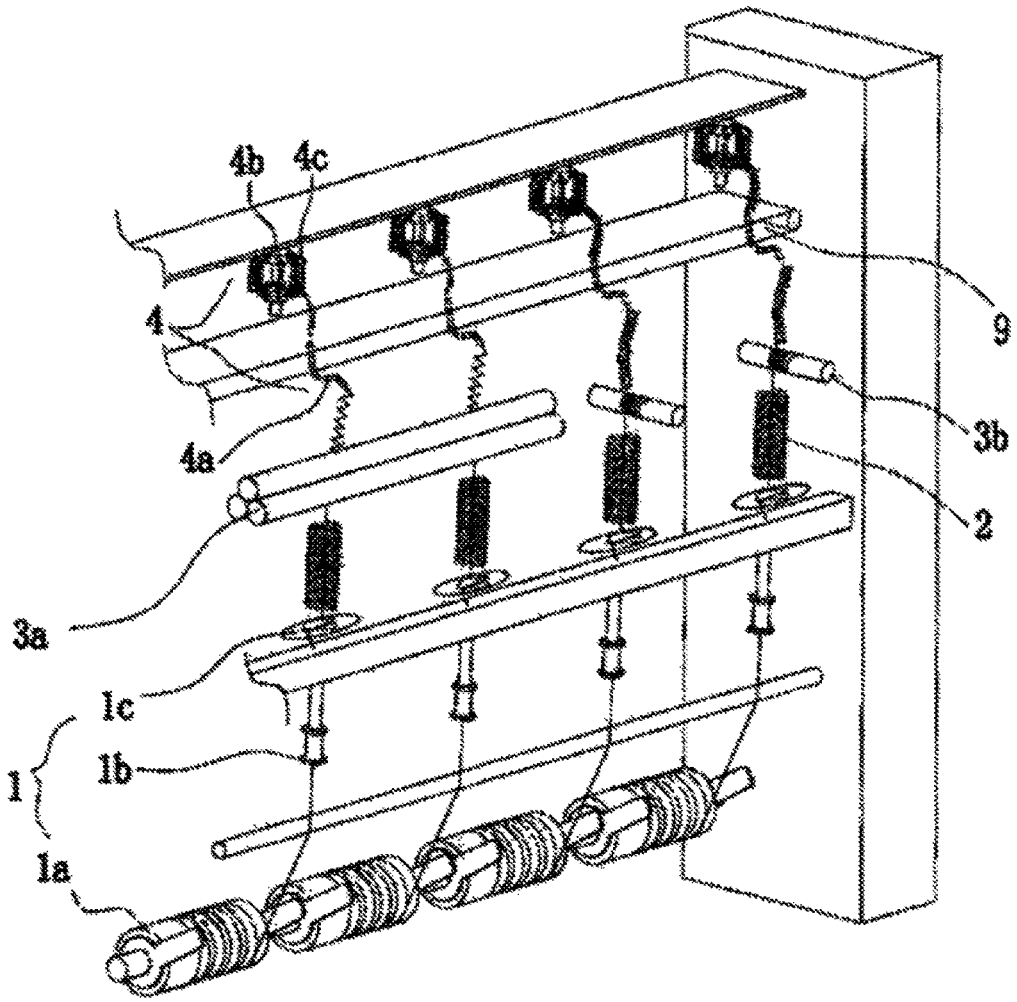
FIG. 1 is a structural diagram of a manufacturing device for a cleaning ball of the present invention.
Figure 2:
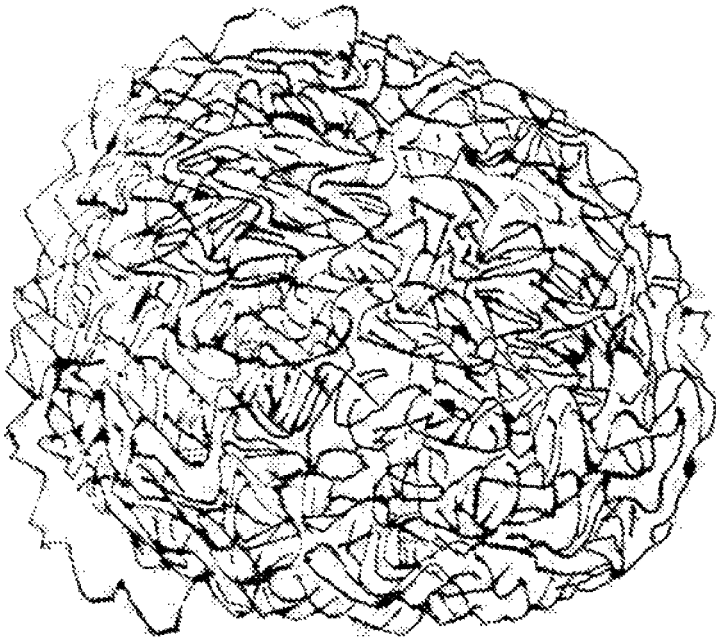
FIG. 2 is a structural diagram of a cleaning ball formed by coiling a wavy fiber yarn body in the present invention.
Figure 3:
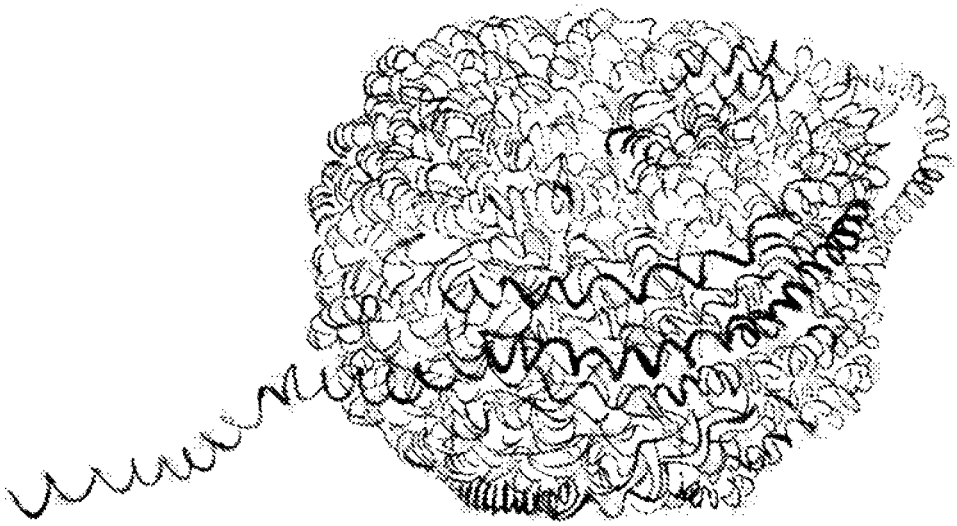
FIG. 3 is a structural diagram of a cleaning ball formed by coiling a spring-shaped fiber yarn body in the present invention.
Figure 4:
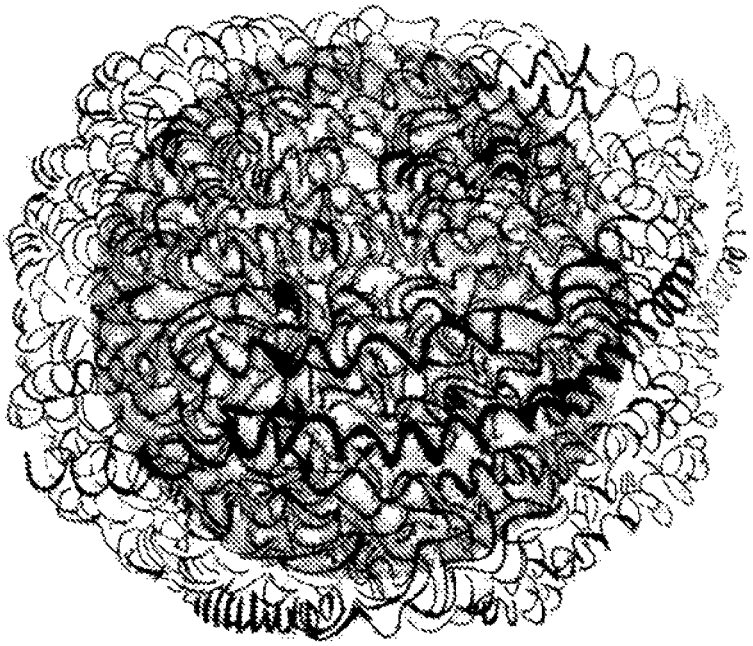
FIG. 4 is a structural diagram of a cleaning ball with sponge therein in the present invention.

With reference to FIG. 1, a manufacturing device for a cleaning ball is formed by arraying a plurality of single units, wherein the single units comprise a cladding mechanism (1) and a coiling mechanism (4); the cladding mechanism (1) comprises a yarn spool (1*a*), a yarn twisting stator (1*b*) on one side of the yarn spool, and a power belt which provides the yarn twisting stator (1*b*) with rotating power and is connected with a motor; the power belt comes into contact with the outer side wall of the yarn twisting stator (1*b*) of each single unit; a yarn storage device (1*c*) is also arranged on the yarn outlet end of the yarn twisting stator (1*b*); the coiling mechanism (4) comprises a yarn feeding mouth (4*a*) and a coiling umbrella (4*b*) corresponding to the yarn feeding mouth (4*a*); the yarn feeding mouth (4*a*) is a bent pipe; a yarn outlet mouth of a nozzle is adapted to the side surface of the coiling umbrella (4*b*); the coiling umbrella (4*b*) is provided with a bracket (4*c*) arranged on an umbrella shaft in an extensible mode; the coiling umbrella (4*b*) rotates under pneumatic or hydraulic drive; during rotation, due to centrifugation, the bracket (4*c*) extends outside; when the coiling umbrella (4*b*) stops rotating, the bracket (4*c*) is contracted inside due to gravity; the coiling umbrella (4*b*) is arranged vertically or transversely; a circle of topped brackets are arranged on the end of the coiling umbrella (4*b*) arranged transversely; the topped brackets are topped to the other end of the coiling umbrella (4*b*) when the coiling umbrella (4*b*) stops supplying energy and the bracket (4*c*) is contracted; a heating mechanism (2) and a shaping mechanism (3) are arranged in sequence between the cladding mechanism (1) and the coiling mechanism (4); the heating mechanism (2) is a spring-shaped pipe body which is hollow inside or is a resistor on the entirety; the shaping mechanism (3) is close to a nozzle of the spring-shaped pipe body, and is a gearset (3*a*) comprising at least two engaged gear shafts in contact or a solid or hollow stick body (3*b*); and a stick shaft of the stick body and a pipe shaft of the spring-shaped pipe body are concentric or become an angle. Dimpled grain is set in the surface of the stick body, and the dimpled grain is annularly arranged on the surface of the stick body in a spiral twisting form.

A hollow cavity wall in the spring-shaped pipe body is communicated with a steam generator, and the spring-shaped pipe body is made of copper. Steam flows in the hollow cavity wall so as to provide the pipe body with heat and heat the stockline in the middle of the pipe body.

A conveyer belt (5) is also arranged below the coiling mechanism (4) of the plurality of single units.

A broken yarn feeding and coiling mechanism of which the end extends to the outer side of the coiling umbrella (4*b*) is arranged on the perimeter of a yarn outlet of the yarn feeding mouth (4*a*). The broken yarn feeding and coiling mechanism comprises a yarn restricting arm and yarn breaking scissors or yarn breaking cutter fixed to the yarn restricting arm. The broken yarn feeding and coiling mechanism performs circumference rotation by using the top as a center of circle under the control of a timer.

A timing switch is arranged on the device which provides power for the coiling umbrella (4*b*).

The principle of the manufacturing device for the cleaning ball of the present invention is as follows:

The fiber yarn made from the polyester fibers with a low melting point is placed on the yarn spool (1*a*) of the cladding mechanism (1); a yarn head penetrates through the yarn twisting stator (10*c*) on one side of the yarn spool, penetrates through a yarn storage device and then penetrates through the shaping mechanism (3) and finally the coiling umbrella (4*b*) of the coiling mechanism (4); the terylene or chinlon to clad the fiber yarn on the yarn twisting stator (1*b*) is twined on the fiber yarn.

For achieving the effect that an end product has different colors, different colors can be selected for the terylene chinlon or other chemical fiber material because the terylene, chinlon or other chemical fiber material clads the outer surface of the fiber yarn.

Of course, for achieving other characteristics, specific chemical fiber material can clad the surface.

The heating mechanism (2) is first preheated. If the spring-shaped pipe body made into the heating mechanism (2) is hollow, a steam generator is started so that the steam enters the hollow inner part of the spring-shaped pipe body. If the spring-shaped pipe body made into the heating mechanism (2) is a resistor, the spring-shaped resistor pipe body is powered; after the heating mechanism (2) is normally operated, a device switch is enabled; yarn feeding mouths (4*a*) of the shaping mechanism (3) and the coiling mechanism (4) begin operating; when the shaping mechanism (3) is a gearset (3*a*) comprising at least two engaged gear shafts in contact, the yarn that penetrates through the gaps formed among the gear shafts is driven by concavo-convex gears with engaged teeth and pulled forwards; and the coiling mechanism (4) coils the shaped wavy yarn under the rotating coiling umbrella (4*b*).

If a solid or hollow stick body (3*b*) is selected as, the shaping mechanism (3), after the yarn is twined on the stick body (3*b*) for several circles, the yarn head is pulled from the back of the several circles into the yarn feeding mouth; (4*a*) of the coiling mechanism (4) and then into the coiling umbrella (4*b*). In this way, when the device is started, the stick body (3*b*) rotates around the end part fixed to the rotating shaft of the motor and drags the yarn to enter the heating mechanism (2) from the cladding mechanism (1), while the coiling umbrella (4*b*) below rotates so that the shaped yarn with spring shape on the stick body (3*b*) is continuously coiled into ball shape.

After the yarn is coiled into ball shape for a period of time, the following several manners can be used for performing operation treatment:

One, the operation of the shaping mechanism (3) is suspended; the yarn is cut from one end where the coiled finished product is appropriate; at this moment, because the coiling umbrella (4*b*) is contracted and the coiling umbrella is vertically or transversely arranged, a circle of topped brackets are arranged on the end part of the coiling umbrella transversely arranged; the topped brackets are topped to the other end of the coiling umbrella when the coiling umbrella stops supplying energy and the bracket is contracted; when the coiling umbrella is vertically arranged, the coiled cleaning ball automatically drops on the conveyer belt (5) or picked up by the worker and thrown on the conveyer belt (5); and when the coiling umbrella is transversely arranged, the topped brackets eject the cleaning ball out of the coiling umbrella (4*b*) to drop on the conveyer belt (5) and then the cleaning ball is delivered into an automatic packaging machine well placed on the end by the conveyer belt (5).

Two, after a period of time, the operation of the shaping mechanism (3) is suspended; the yarn is cut from one end where the coiled finished product is appropriate; at this moment, because the coiling umbrella (4*b*) is contracted, the coiled cleaning ball automatically drops on the conveyer belt (5) and is delivered into an automatic packaging machine well placed on the end by the conveyer belt (5).

For achieving that the yarn twisting stator (1*b*) continues to rotate when the operation of the shaping mechanism (3) is suspended, the preferred treatment solution is to store the yarn through a yarn storage device.

Of course, a clutch can also be connected between the power belt and the motor, and the clutch is also connected with a switch of the coiling mechanism (4). In this way, when a provisional switch of a corresponding device is pressed, the coiling mechanism (4) stops supplying energy; the rotation is weakened slowly; the clutch enables the power belt to be separated from the motor; and the yarn twisting stator (1*b*) does not perform cladding operation.

If the suspension solution is not used, the broken yarn feeding and coiling mechanism is controlled by a timer to rotate. When the coiling umbrella (4*b*) rotates, the timing switch disconnects the power given to the coiling umbrella (4*b*); the timer controls the broken yarn feeding and coiling mechanism to rotate; the yarn restricting arm on the broken yarn feeding and coiling mechanism does circumferential motion around the top, while the yarn outlet mouth end of the yarn feeding mouth (4*a*) is just within the scope of the yarn restricting arm in doing circumferential motion, namely that when the yarn restricting arm does circumferential motion around the top, the yarn between the yarn outlet mouth end of the yarn feeding mouth (4*a*) and the coiling umbrella (4) is restricted into the yarn restricting arm and is driven to continue rotating on the coiling umbrella (4*b*); because the coiling umbrella (4*b*) does not have power, the rate of the yarn restricting arm is higher than that of the coiling umbrella; the yarn is close to the yarn breaking scissors or yarn breaking cutter under the yarn restricting arm, the yarn is cut by the yarn breaking scissors or yarn breaking cutter; then, the bracket of the coiling umbrella (4*b*) is contracted; the cleaning ball is separated from the coiling umbrella (4*b*) and drops on the conveyer belt (5); the control current of the timer is reverse; the yarn restricting arm rotates reversely; the shaping mechanism (3) always delivers the yarn downwards; the yarn in the yarn restricting arm is separated from the yarn restricting arm; then, after the yarn restricting arm rotates reversely by one circle, the yarn is touched; the yarn dropping from the yarn feeding mouth (4*a*) is increasingly longer; the timer then closes the electric power of the broken yarn feeding and coiling mechanism; at the same time, the timing switch controls the coiling umbrella (4*b*) to obtain the power again to start to rotate; the yarn is directly coiled in and then twined again by the bracket that is unfolded quickly; and in this way, the yarn can be cut to make a finished product without suspending the yarn twisting stator.

Figure 5:
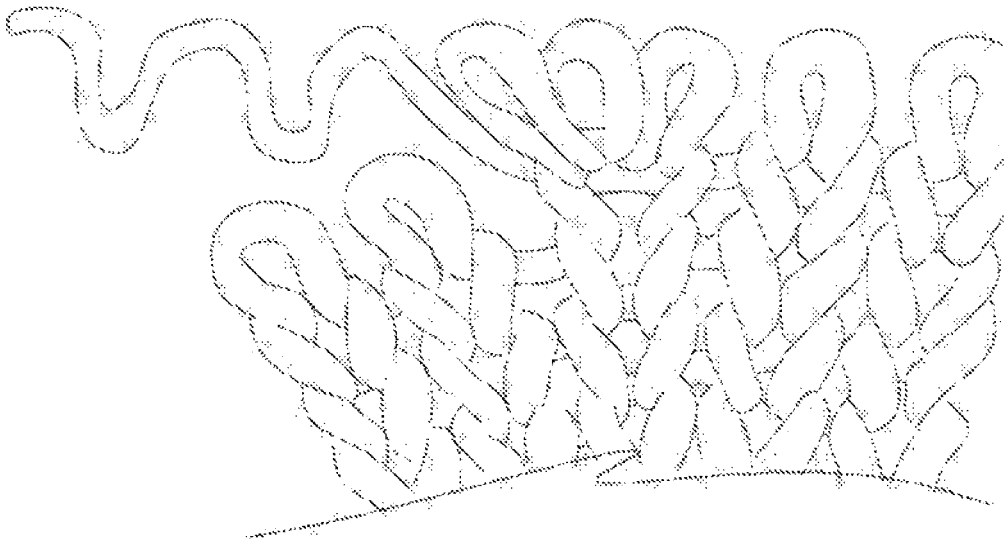
FIG. 5 is a structural diagram of partial disassembly of the cleaning ball after being knitted into wool via a knitting machine in the present invention.
Figure 6:
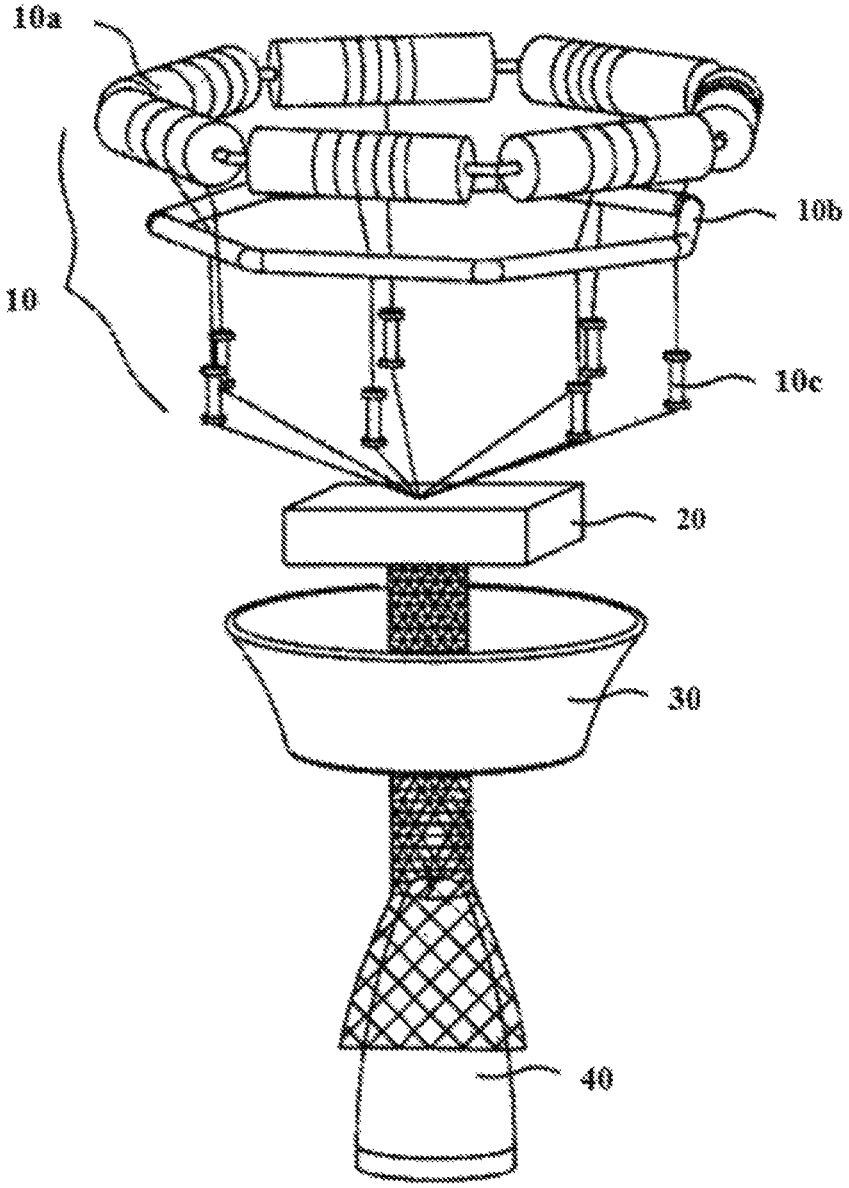
FIG. 6 is a structural diagram of a manufacturing device for cleaning cloth of the present invention.
Figure 7:
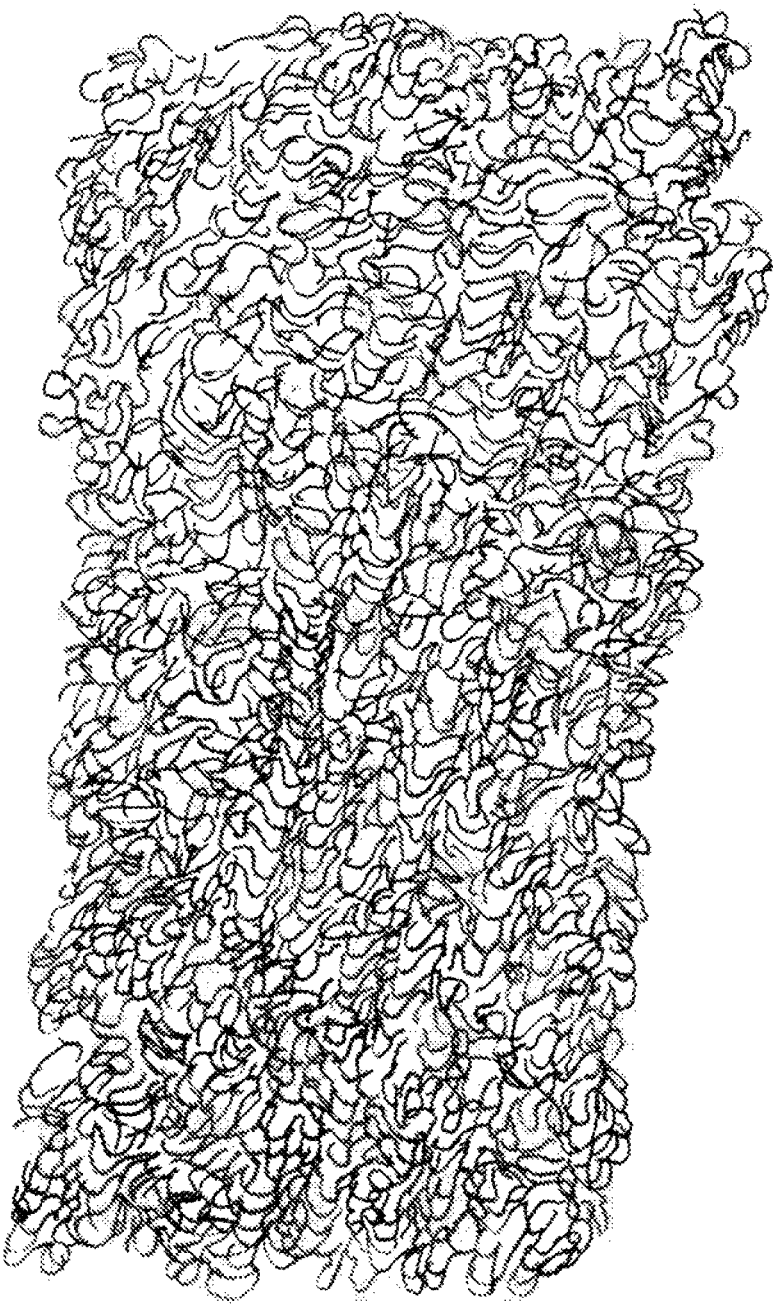
FIG. 7 is a structural diagram of the cleaning, cloth of the present invention.
Figure 8:
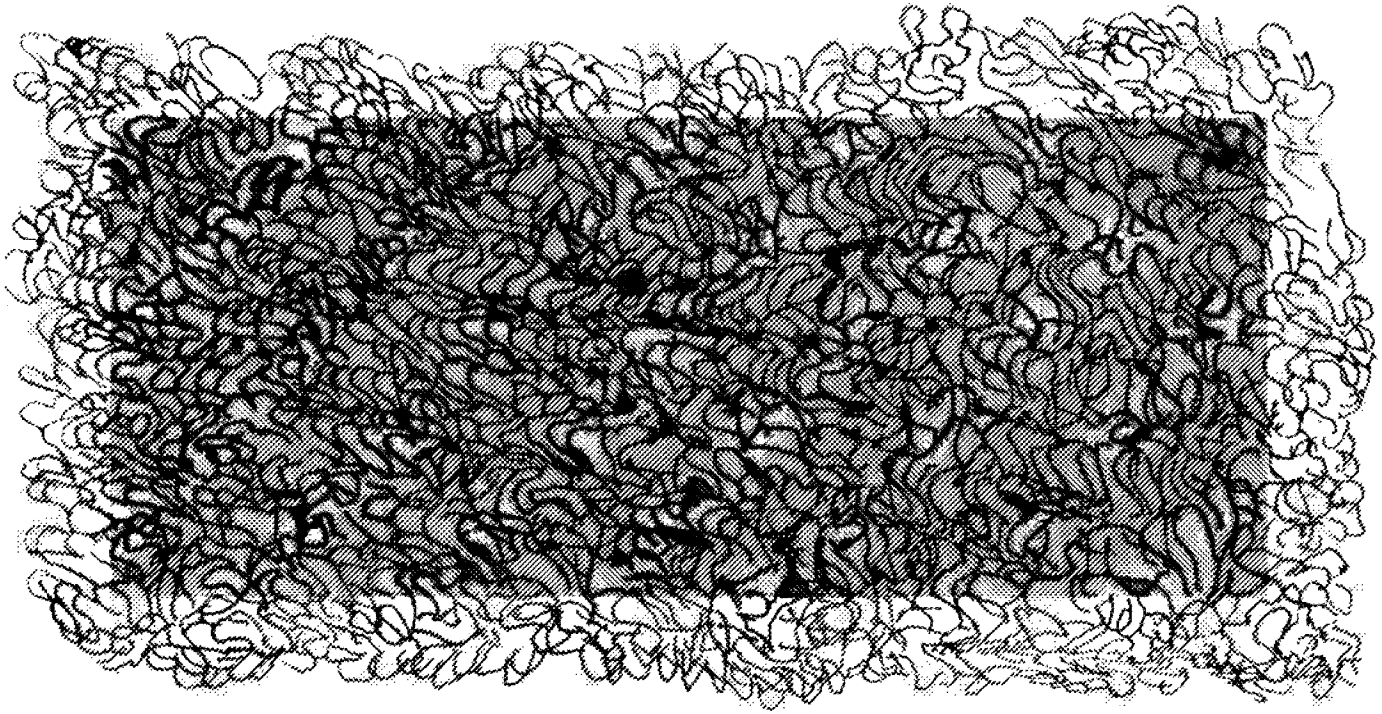
FIG. 8 is a structural diagram of cleaning cloth with sponge therein in the present invention.

With reference to FIG. 5, step three to step four in manufacturing the cleaning ball can be replaced by the following steps:

Three, knitting: knitting the stockline into wool via a knitting machine;

Four, heating and shaping: heating the space where the wool is located to enable the temperature to achieve the melting point value of the polyester fibers with a low melting point and shaping after the temperature drops; and Five, disassembling: disassembling the wool; and the disassembled stockline has presented wave or spring shape.

As shown in FIG. 5, the knitted wool is similar to a sweater. After being heated and shaped, the stockline is bent due to its structure; then, the wool is disassembled; in this way, strips of wavy or spring-shaped stockline are made; and the stockline is automatically balled via a balling machine.

A manufacturing method for cleaning cloth comprises the following steps:

One, selecting raw material center yarn: selecting fiber yarn made from polyester fibers with a low melting point of which the melting point is below 180° C. as the raw material center yarn, and the preferred melting point is 100° C.;

Two, cladding the yarn: cladding the outer surface of the raw material center yarn with chemical fiber raw material of terylene or chinlon to form stockline;

Three, weaving: weaving the stockline into a barrel shape through the knitting mechanism;

Four, shaping: shaping after heating the knitted fabric to the melting point value of the polyester fibers with a low melting point;

Five, missed stitches: forcing the knitted fabric to penetrate through a flared or shuttle-shaped mould so as to be expanded and stretched so that missed stitches are formed between the fabric; and Six, breaking the yarn to make a finished product: cutting the fiber fabric to finish manufacturing the cleaning cloth.

With reference to FIG. 5, a manufacturing device for cleaning cloth is formed by arraying a plurality of single units, wherein the single units comprise a plurality of cladding mechanisms (10) and spinning and weaving mechanisms (20); each cladding mechanism (10) comprises a yarn spool (10*a*), a friction roller in friction with the yarn spool (10*a*), a filament moving rod (10*b*) under the friction roller, a filament moving mouth mounted on the filament moving rod (10*b*), a yarn twisting stator (10*c*) under the filament moving rod, and a power belt which provides the yarn twisting stator (10*c*) with rotating power and is connected with a motor; a weaving mechanism (20) comprises a weaving machine head arranged under the yarn twisting stator (10*c*); a heating mechanism (30) is arranged under the weaving machine head; the heating mechanism (30) is a barrel body with a cavity; and a flared or shuttle-shaped expansion mould (40) is placed under the heating mechanism.

The outer cavity wall of the barrel body is hollow and a steam generator is connected with the hollow outer cavity to form a loop.

The outer cavity ring of the barrel body is provided with a heating wire.

The principle of the manufacturing device for the cleaning cloth of the present invention is as follows:

The fiber yarn made from the polyester fibers with a low melting point is placed on the yarn spool (10*a*) of the cladding mechanism (10); a yarn head penetrates through the filament moving mouth on the filament roving rod (10*c*) mounted under the friction roller and then penetrates through the yarn twisting stator (10*c*) to the weaving mechanism (20) in sequence; the terylene or chinlon to clad the fiber yarn on the yarn twisting stator (10*c*) is twined on the fiber yarn.

For achieving the effect that an end product has different colors, different colors can be selected for the terylene or chinlon because the terylene or chinlon clads the outer surface of the fiber yarn.

The heating mechanism (30) is first preheated for some time a power switch is turned on; the weaving machine head where the weaving mechanism (20) is located begins to work, pulls the yarn and passes through the yarn spool (10*a*), the filament moving rod (10*c*) and the yarn twisting stator (10*c*) in sequence; finally, barrel-shaped fabric is woven; at the time of weaving, the woven barrel-shaped fabric penetrates through the middle of the barrel body of the heating mechanism (30) fixed under the weaving machine head, while the outer cavity wall of the barrel body is hollow where steam can be introduced or an electric heating wire is annularly arranged; the temperature of the steam or electric heating wire achieves the melting point value of the polyester fibers with a low melting point, namely that the barrel-shaped fabric is shaped after passing through the heating mechanism (30); then, when the barrel-shaped fabric that passes through the heating mechanism (30) achieves certain length, a worker forces the end part of the barrel-shaped fabric to penetrate through the flared or shuttle-shaped expansion mould (40) so that the surface body of the fabric formed by alternately weaving part warp and weft is forcedly broken to form a missed stitch phenomenon, similar to a stream filament phenomenon when silk stockings are worn, causing that the fabric with larger density and smaller volume becomes a state with large density and, fluffy entirety; and finally, the expanded fabric and the upper fabric not expanded by the expansion mould (40) are cut by the worker.

During outage, a power supply is turned off and the yarn twisting stator (10*c*) is synchronously turned off.

The cleaning ball or cleaning cloth manufactured can be used for cleaning the nonstick pan without damaging paint surface, has long service life, is not easy to generate bacteria, does not rot after long-term use, and has wide cleaning scope for cleaning bowls, fruit, ceramic tiles and floor. Even ink and engine oil attached to skin can be conveniently cleaned and eliminated by using a little hand sanitizer. Moreover, the skin or users' hands will not be injured regardless of the force.

Because the cleaning ball is formed by adopting the polyester fibers with a low melting point and cladding other fibers, the cleaning ball does not have water absorptivity on the entirety. During production, the stick body used for the shaft center to rotate manually on the coiling mechanism replaces the coiling umbrella. In this way, sponge with different shapes can be inserted on the stick body; and then the stick body rotates so that the stockline clads the periphery of the sponge, so the technical problem that the cleaning ball does not absorb water can be well compensated through the water absorptivity of the sponge. The two are complimentary and can extend more cleaning products.

However, for the cleaning cloth, the sponge can be directly plugged into the cleaning cloth, and flexible fixed yarn can penetrate through the cleaning cloth and the sponge to fix the two. Without the sponge, the cleaning cloth can be folded for use and a better hand feeling can be obtained.

I claim:

1. A manufacturing method for a cleaning ball, comprising:

selecting raw material center yarn; selecting fiber yarn made from polyester fibers with a melting point below 180° C. as the raw material center yarn;

cladding the yarn; cladding the outer surface of the raw material center yarn with stockline formed by terylene or chinlon;

heating; heating the stockline to a melting point value of the polyester fibers with a low melting point;

shaping; twining and shaping the stockline through a heating stick or crushing and shaping by traversing the gaps among a plurality of gears;

balling via a network; balling the shaped stockline on a coiling umbrella via a yarn feeding mouth network; and breaking the yarn to make a finished product; after related time, cutting the stockline between a yarn feeding mouth and the coiling umbrella to enable the cleaning ball on the umbrella to drop.

2. The manufacturing method of claim 1, wherein the steps of heating and shaping can be replaced with the following steps:

knitting: knitting the stockline into wool through a knitting machine;

heating and shaping: heating the space where the wool is located to enable the temperature to achieve the melting point value of the polyester fibers with a low melting point and shaping after the temperature drops; and disassembling: disassembling the wool.

* * * * *